US009138766B2

(12) United States Patent
Ströhlein et al.

(10) Patent No.: US 9,138,766 B2
(45) Date of Patent: Sep. 22, 2015

(54) NOZZLE FOR APPLYING A COATING AGENT

(75) Inventors: Stefan Ströhlein, Schwaigern (DE); Marc Engelhart, Sinsheim (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 203 days.

(21) Appl. No.: 13/817,354

(22) PCT Filed: Aug. 17, 2011

(86) PCT No.: PCT/EP2011/004143
§ 371 (c)(1), (2), (4) Date: Mar. 12, 2013

(87) PCT Pub. No.: WO2012/022477
PCT Pub. Date: Feb. 23, 2012

(65) Prior Publication Data

US 2013/0216716 A1 Aug. 22, 2013

(30) Foreign Application Priority Data

Aug. 20, 2010 (DE) ..... 10 2010 034 921

(51) Int. Cl.

| | |
|---|---|
| ***B05B 15/08*** | (2006.01) |
| ***B05C 5/02*** | (2006.01) |
| ***B05B 1/16*** | (2006.01) |
| ***B05B 13/06*** | (2006.01) |

(52) U.S. Cl.
CPC ..... *B05B 15/08* (2013.01); *B05B 1/1672* (2013.01); *B05B 13/0627* (2013.01); *B05C 5/0233* (2013.01); *B05C 5/0279* (2013.01)

(58) Field of Classification Search
CPC .. B05B 13/0627; B05B 15/08; B05B 1/1672; B05C 5/0233; B05C 5/0279
USPC ..... 427/421.1
See application file for complete search history.

(56) References Cited

U.S. PATENT DOCUMENTS

| | | | | |
|---|---|---|---|---|
| 4,995,333 | A * | 2/1991 | Keller et al. | 118/300 |
| 5,078,799 | A | 1/1992 | Matter et al. | |
| 2008/0179429 | A1* | 7/2008 | Beilke et al. | 239/589 |
| 2010/0260531 | A1* | 10/2010 | Rademacher | 401/146 |
| 2012/0097097 | A1* | 4/2012 | Ikushima | 118/300 |

FOREIGN PATENT DOCUMENTS

| | | | |
|---|---|---|---|
| DE | 1066503 | | 4/1967 |
| DE | 2526702 | A1 | 12/1976 |
| DE | 2827770 | | 3/1980 |
| DE | 3337980 | | 9/1985 |
| DE | 3443661 | C2 | 11/1988 |
| DE | 102004046351 | A1 | 3/2006 |
| DE | 102007036870 | | 2/2009 |

(Continued)

*Primary Examiner* — Alexander Weddle
(74) *Attorney, Agent, or Firm* — Bejin Bieneman PLC

(57) ABSTRACT

A nozzle, comprises an elongated hollow lance configured for feeding a coating agent through the lance along a longitudinal axis of the lance and at least one nozzle opening configured for dispensing the coating agent. The nozzle opening is arranged in a lateral surface of the lance and dispenses the coating agent sideways with respect to the longitudinal axis of the lance. The nozzle opening is rotatable about the longitudinal axis of the lance such that the coating agent can be dispensed in differenct directions according to an angular position of the nozzle opening.

20 Claims, 8 Drawing Sheets

(56) References Cited

FOREIGN PATENT DOCUMENTS

Figure 1:
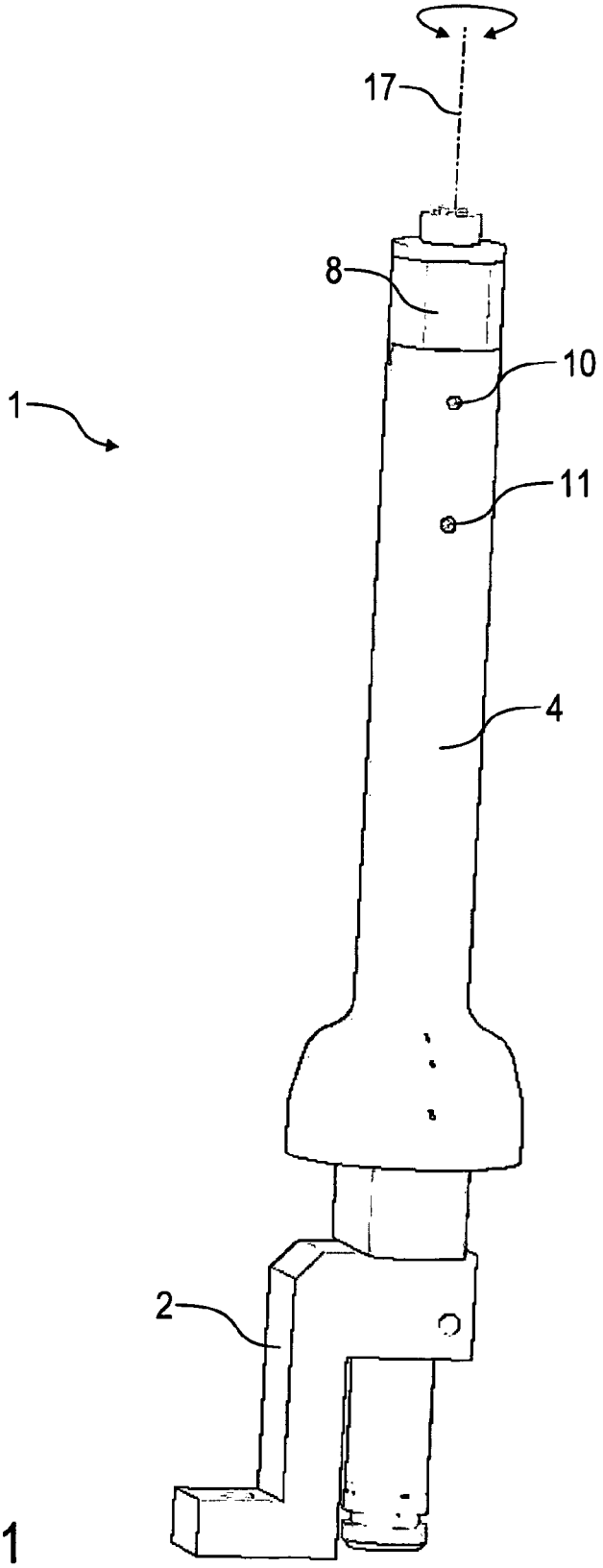

| | | | | |
|---|---|---|---|---|
| EP | 0941788 | | | 9/1999 |
| EP | 1591166 | A1 | | 11/2005 |
| EP | 1591166 | A1 | * | 11/2005 |
| EP | 2228136 | A2 | | 9/2010 |
| JP | H05004057 | | | 1/1993 |
| WO | WO 2009059753 | A1 | * | 5/2009 |
| WO | WO 2010123097 | A1 | * | 10/2010 |

* cited by examiner

NOZZLE FOR APPLYING A COATING AGENT

In modern painting installations for painting motor vehicle body components, the motor vehicle body components to be painted are not only painted with the actual paint, but a seam sealing is also performed to help provide corrosion protection. Seam sealing may include application of a wax or other suitable coating agent to a seam (e.g. a flanged seam) along the seam by a robot-guided nozzle to prevent the seam from experiencing corrosion later. Known nozzles for applying a wax in the context of such seam sealing may include an elongated, hollow lance with a nozzle opening arranged in the lateral surface of the lance, through which the wax is applied. During the seam sealing, the lance may accordingly be positioned by a multi-axis robot so that the nozzle opening is always directed at the seam, which requires a high expenditure of processing for positioning the multi-axis robot. This positioning expenditure when guiding the known nozzles in turn leads to an extension of the required cycle time, and reduces the operating speed of the painting installation.

The same problems exist when preserving cavities with a preserving agent. Reference must also be made to EP 1 591 166 A1, U.S. Pat. No. 5,078,799 A, DE 10 2007 036 870 A1, DE 10 66 503 B and EP 0 941 788 A1, which describe additional general prior art.

As disclosed herein, a nozzle opening located in the lateral surface of a lance may be rotatable about the longitudinal axis of the lance, so that a coating agent (e.g. wax, preservation agent) can be dispensed in different directions according to an angular position of the nozzle opening. Therefore, in addition to a freedom of movement of a robot guiding the nozzle, the nozzle offers an additional degree of freedom so that positioning efforts of the robot are decreased because the nozzle itself can guide the nozzle opening into the desired direction.

The nozzle may include an elongated hollow lance that also serves for feeding a coating agent to be applied. In the lateral surface of the lance, there is at least one nozzle opening for discharging the coating agent, wherein the nozzle opening, with respect to the longitudinal axis of the lance, dispenses the coating agent in a sideways direction. In contrast to a conventional nozzle such as mentioned above, however, the nozzle opening can be rotated about a longitudinal axis of the lance so that a coating agent can be dispensed in a desired direction.

The lance may have a hollow inner nozzle pipe and a hollow outer nozzle pipe, wherein the inner nozzle pipe and the outer nozzle pipe are arranged coaxially and can be rotated relative to each other. The inner nozzle pipe may be arranged fixedly, whereas the outer nozzle pipe can be rotated.

The nozzle opening may be included in a wall of the rotatable outer nozzle pipe so that an angular position of the outer nozzle pipe determines a direction of application, i.e. a direction in which a coating agent is dispensed. For example, in the wall of the inner nozzle pipe, there may be at least one radially continuous borehole, which is aligned in a specific angular position of the outer nozzle pipe with the nozzle opening in the wall of the outer nozzle pipe so the coating agent can flow out of the nozzle opening. In this configuration, the coating agent is therefore fed via the hollow inner nozzle pipe, and then flows through the radially continuous borehole in the wall of the inner nozzle pipe, and finally through the nozzle opening in the wall of the outer nozzle pipe.

Further, there may be a sleeve-shaped gasket between the outer nozzle pipe and the inner nozzle pipe, The sleeve-shaped gasket surrounds the inner nozzle pipe in a circular manner, wherein the sleeve-shaped gasket may be fixed relative to the outer nozzle pipe, and there may be at least one radial borehole in its wall that is substantially flush with the borehole in the wall of the inner nozzle pipe. Furthermore, the sleeve-shaped gasket may respectively have an O-ring seal in the area of the radially continuous boreholes in order to seal the respective borehole.

Accordingly, the inner nozzle pipe and the outer nozzle pipe together may form a rotary slide valve with the rotating outer nozzle pipe as a control element, wherein the rotary slide valve releases or locks the nozzle opening depending on an angular position of the outer nozzle pipe.

The nozzle openings may be either released or locked by the rotary slide valve depending on the angular position of the outer nozzle pipe, essentially without interruption. It is, however, alternatively possible for the rotary slide valve to have an angle-dependent continuous valve characteristic, so that the nozzle openings are more or less released or locked depending on the angular position.

In addition, the rotary slide valve may release or lock different nozzle openings at different angular positions. For instance, two nozzle openings can be provided, wherein in a first angular position, the first nozzle opening is released and the second nozzle opening is locked, whereas in a second angular position, the first nozzle opening is locked and the second nozzle opening is released.

The different nozzle openings may be positioned in the outer nozzle pipe along the longitudinal axis of the lance in an axial extending line, i.e. without an angle offset in the circumferential direction. It is, however, alternatively possible in the framework of the invention for several nozzle openings to be distributed across the circumference.

In addition, the different nozzle openings may be spaced apart from one another axially. It is, however, alternatively possible for the nozzle openings to be spaced apart from one another in the circumferential direction, but have a substantially same position in the axial direction.

Furthermore, the nozzle may have a locking mechanism to lock the rotatable nozzle opening in a certain angular position. The locking mechanism may provide for several different locking positions to support dispensing the coating agent in different directions. For instance, the locking mechanism may have four different locking positions, each with an angle offset of substantially 90°.

For instance, the locking mechanism may have at least one resilient pressure piece and at least one locking receptacle, wherein the pressure piece can lock in a resilient manner in the locking receptacle to lock the nozzle in an angular position. If there are several locking positions, each locking position may be assigned a locking receptacle. In this constructive realization of the locking mechanism, the pressure piece on the one hand and the locking receptacle on the other hand are arranged in parts of the nozzle that can be rotated relative to each other. For instance, the locking receptacles may be arranged in the proximal end face of the outer nozzle pipe, whereas the resilient pressure piece is in a fixed support.

The nozzle may be rotated, for instance, manually using a wrench or another tool. To this end, the nozzle may have a wrench surface in which the wrench can engage. The wrench surface may be formed on a separate driver that is connected in a form-fitting manner to the outer nozzle pipe. The form-fitting connection between the driver on the one hand and the outer nozzle pipe on the other can be realized, for instance, in such a way that the outer nozzle pipe has an axial re-entering groove in its wall on the front side in which a corresponding axial projecting tongue on the driver engages.

It is, however, alternatively possible for the nozzle to have an integrated pivoting apparatus to rotate the nozzle opening to the desired angular position. For instance, such a pivoting apparatus can be operated electro-mechanically, pneumatically, hydraulically or by other means.

The nozzle opening may be rotatable without any limitation of the angle of rotation. This means that the nozzle opening can be rotated as far as desired in any direction without the nozzle opening needing to be rotated back again. This is advantageous because the positioning expenditure is thereby reduced, which contributes to accordingly shorter cycle times.

The nozzle according described above as an individual component may be included in a complete application device with such a nozzle. In the context of such an application device, the nozzle can for instance by guided by a multi-axis robot.

In addition, it should be noted that the term "coating agent" used herein is not limited to waxes or other preserving agents that are used during seam sealing or during preserving cavities. Rather, this term also comprises other coating agents such as acoustic foam for sound insulation, corrosion protection agents, coating agents for disc flange masking, preserving agents for preserving cavities, and coating agents for underbody protection, just to name a few examples.

As also disclosed herein, a nozzle may be used for applying wax or another preserving agent during seam sealing or cavity preservation on a vehicle body component.

Figure 2:
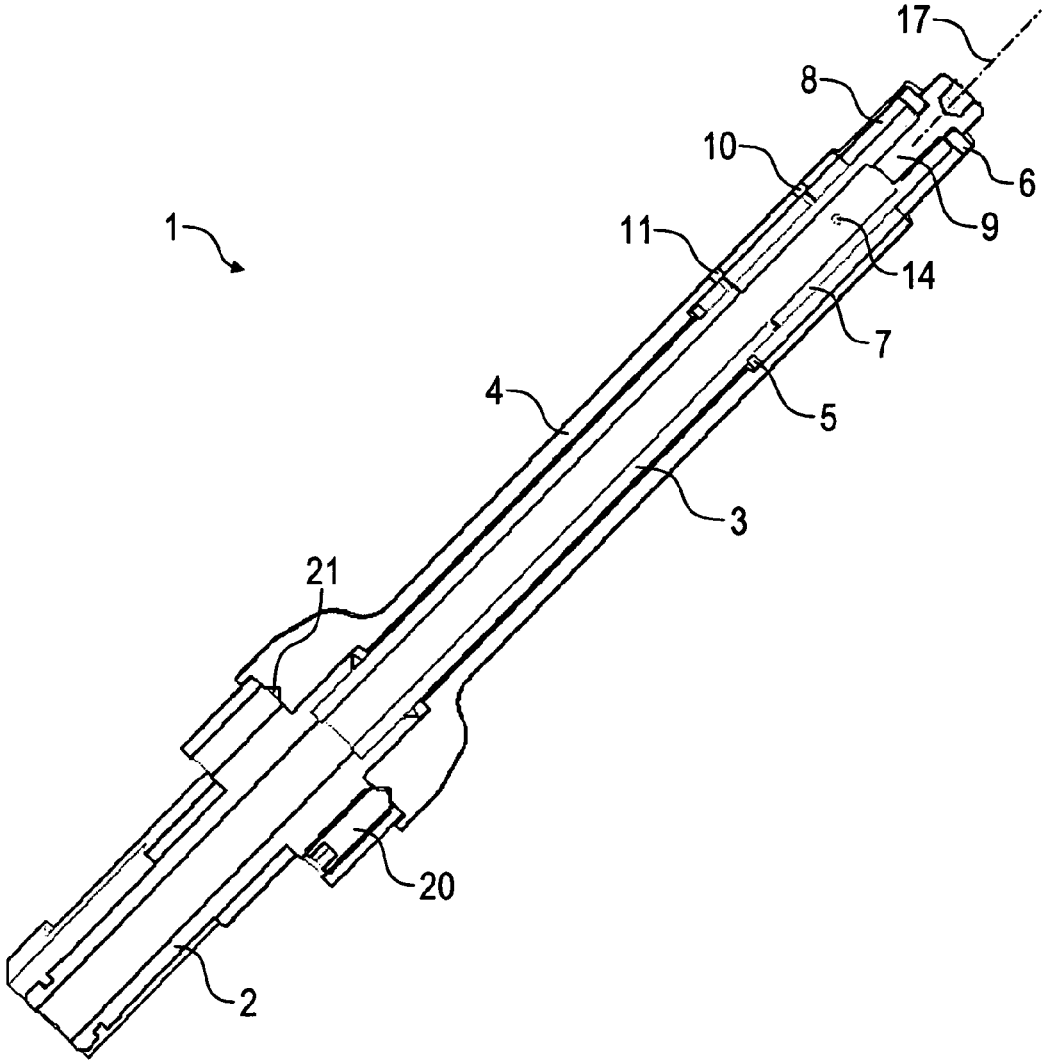
Figure 3:
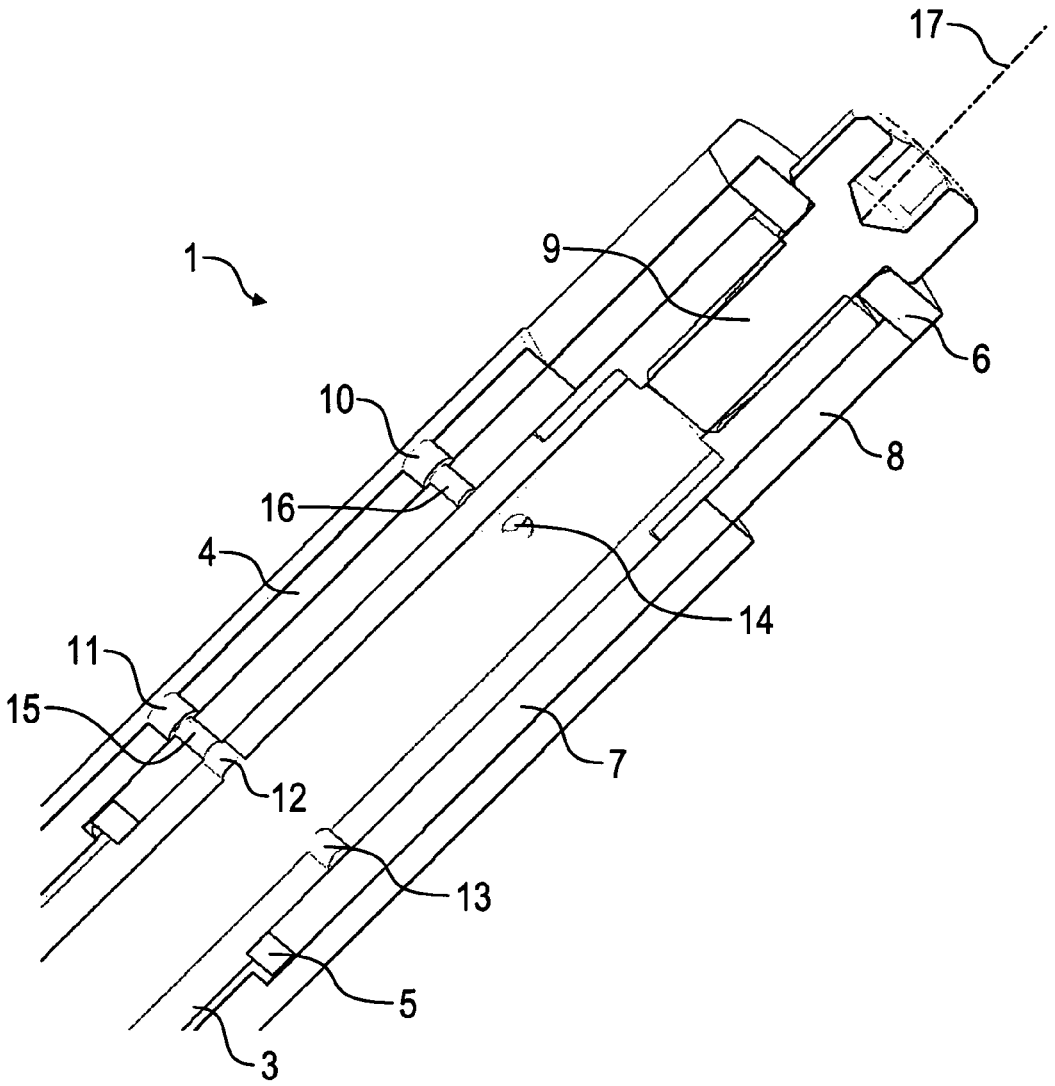
Figure 4:
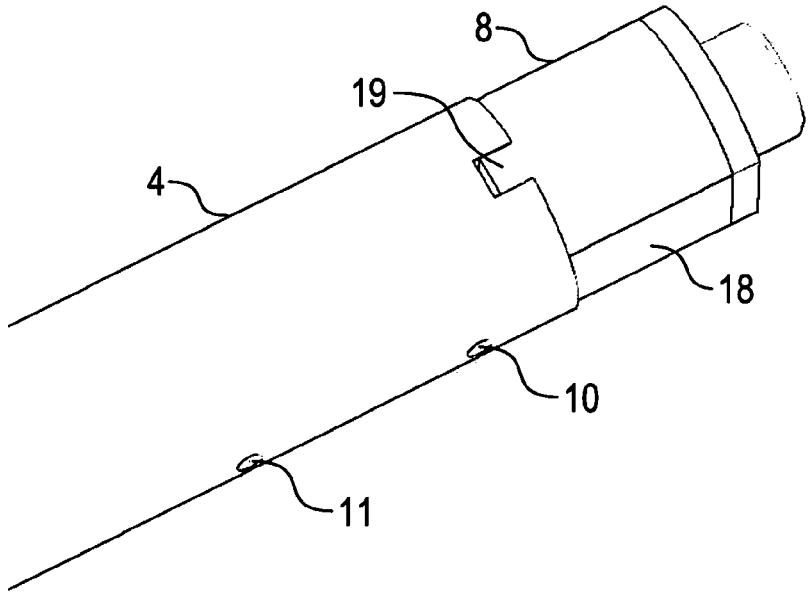
Figure 5:
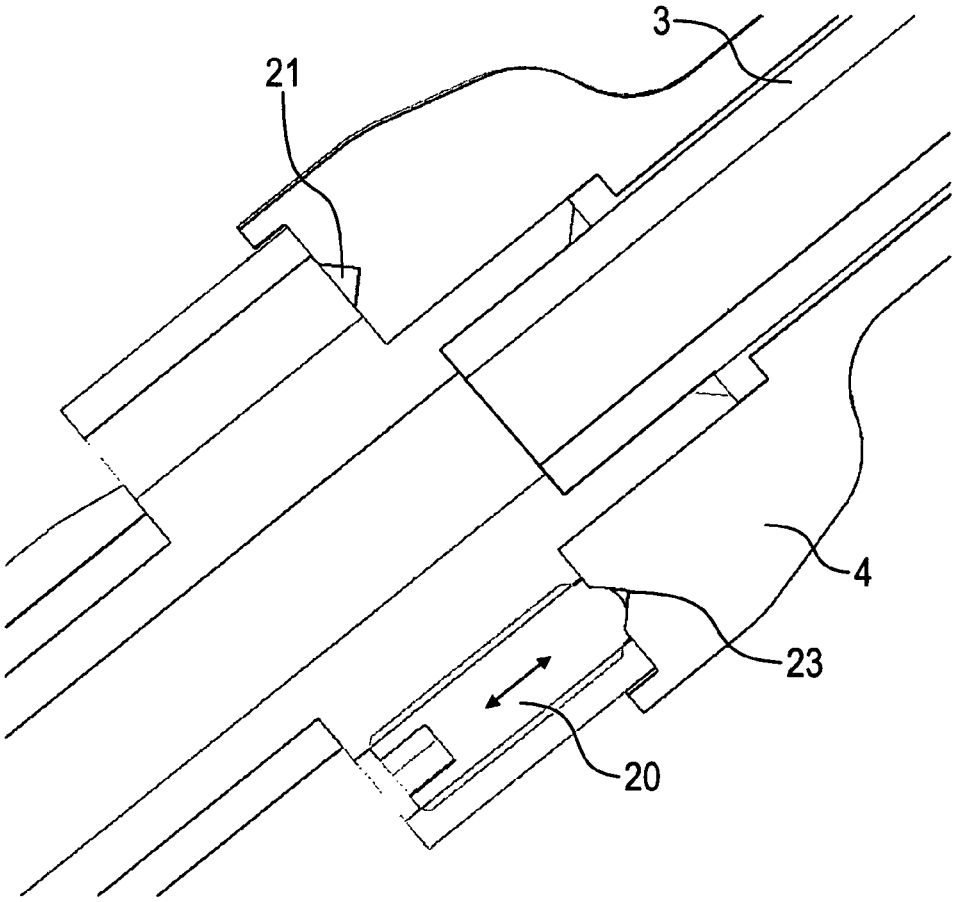
Figure 6:
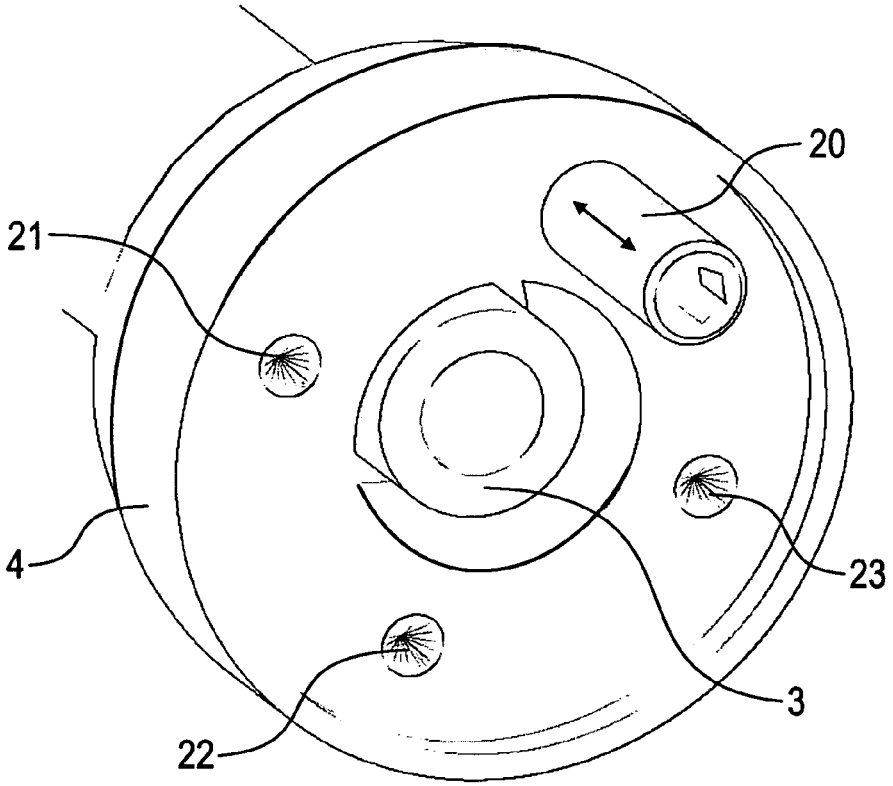
Figure 7:
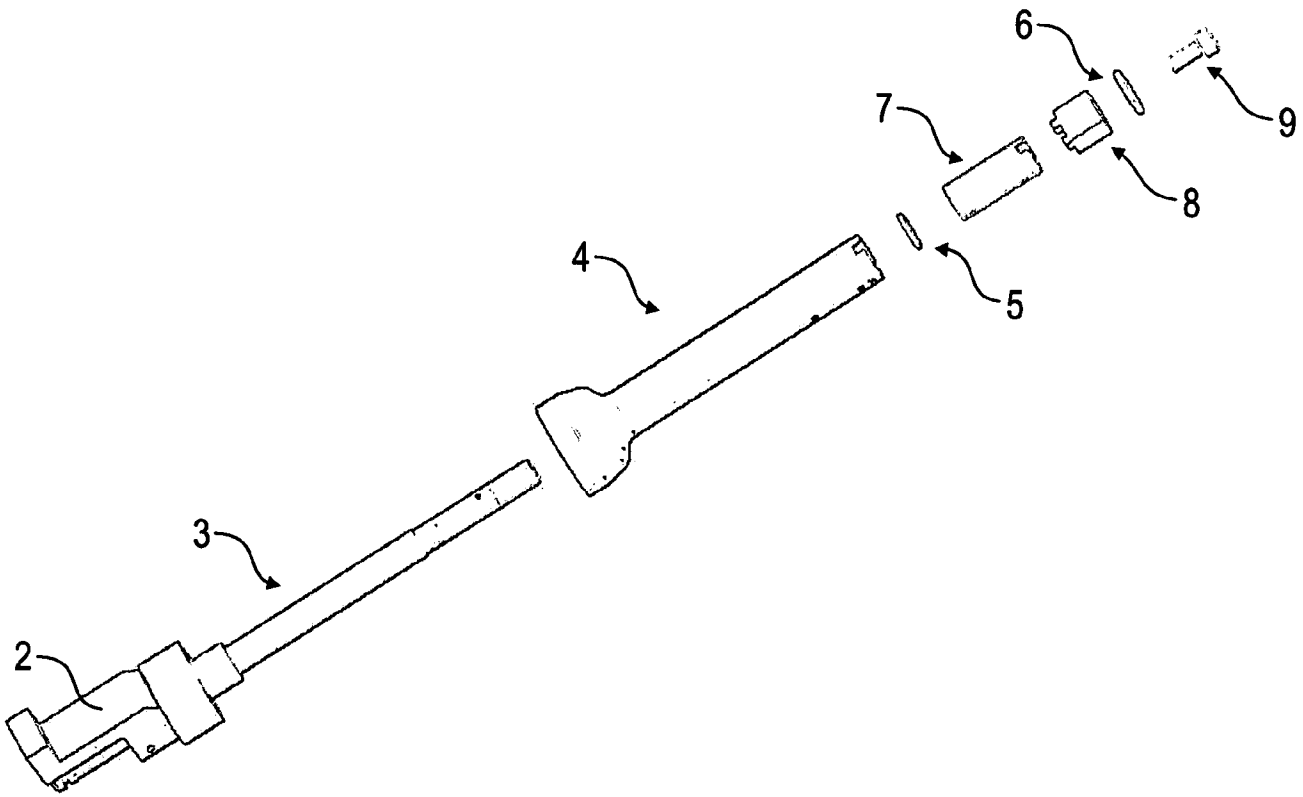
Figure 8:
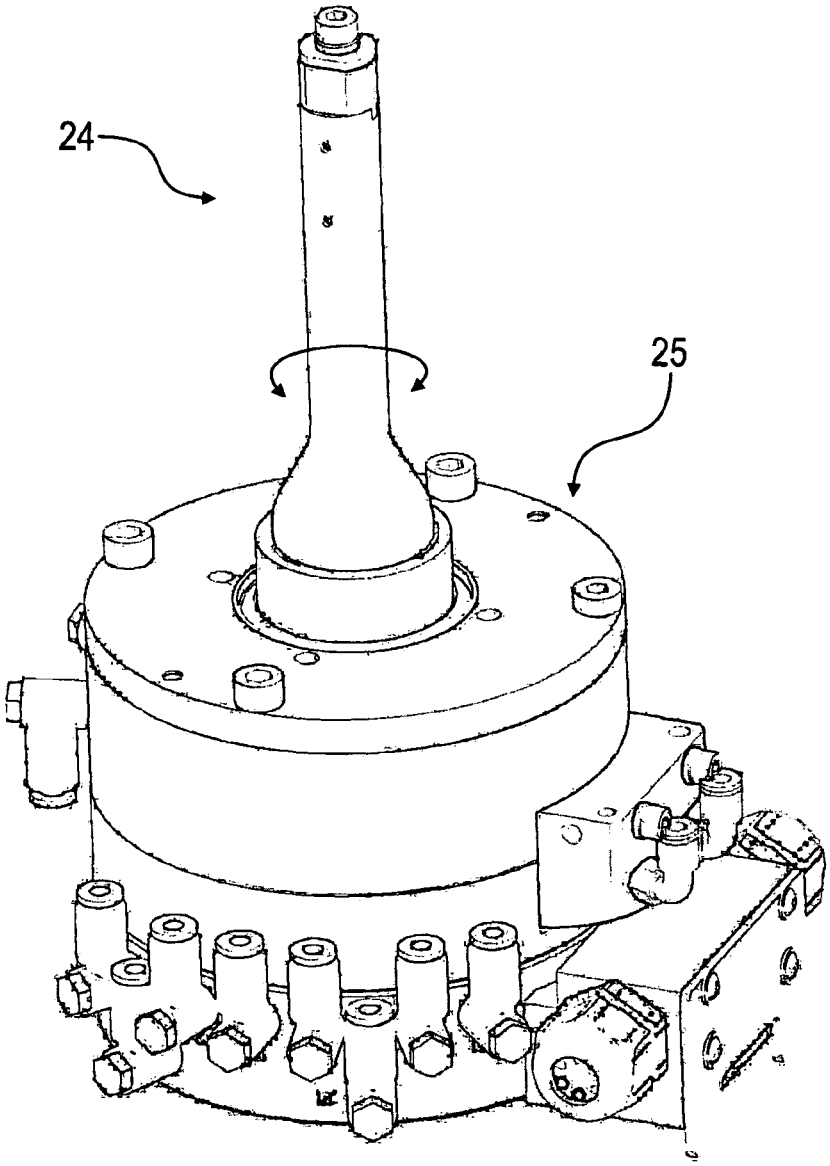

The figures show as follows:

FIG. 1: a perspective side view of an exemplary nozzle for applying wax during seam sealing or cavity preservation on a motor vehicle body component, FIG. 2: a longitudinal section through the nozzle of FIG. 1, FIG. 3: a detailed view of the longitudinal section from FIG. 2 in the front region of the nozzle, FIG. 4: a perspective side view of the front region of the nozzle of FIG. 1, FIG. 5: a magnification of the longitudinal section from FIG. 2 in the rear region of the nozzle, FIG. 6: a perspective view of the locking mechanism of the nozzle of FIG. 1, FIG. 7: a perspective exploded view of the nozzle from FIG. 1, FIG. 8: an exemplary application device with a nozzle.

FIGS. 1 to 7 illustrate different views of a first exemplary nozzle 1 that can be used in the framework of seam sealing or cavity preservation on a motor vehicle body component for applying wax or another preserving agent.

Using a support 2, the nozzle 1 can be guided by a conventional multi-axis robot to apply wax along a seam or within a cavity.

Here, the nozzle 1 consists essentially of a hollow inner nozzle pipe 3, and also hollow outer nozzle pipe 4, two washers 5, 6, a sleeve-shaped gasket 7, a driver 8 and a mounting screw 9, which is particularly apparent in the exploded view in FIG. 7.

The inner nozzle pipe 3 is arranged fixed in the nozzle 1, whereas the outer nozzle pipe 4 can be rotated relative to the inner nozzle pipe, wherein the inner nozzle pipe 3 and the outer nozzle pipe 4 are arranged coaxially.

In a wall of the outer nozzle pipe 4, there are two nozzle openings 10, 11, wherein the two nozzle openings 10, 11 are arranged along an axial line, i.e. without an angle offset in the circumferential direction, but spaced apart axially from each other.

In a wall of the inner nozzle pipe 3, there are also radially continuous boreholes 12, 13, 14 to allow wax to get from the inside of the inner nozzle pipe 3 to the nozzle openings 10, 11 in the outer nozzle pipe 4.

Furthermore, the sleeve-shaped gasket 7 is located between the outer nozzle pipe 4 and the inner nozzle pipe 3, wherein two radially continuous boreholes are arranged in the wall of the gasket 7.

In the angular position of the outer nozzle pipe 4 illustrated in FIG. 3, the nozzle opening 11 in the outer nozzle pipe 4 is aligned with the borehole 15 of the gasket 7 and the borehole 12 in the inner nozzle pipe 3 so that the wax can flow from the inside of the inner nozzle pipe 3, through the boreholes 12, 15 and out of the nozzle opening 11. In contrast, in this angular position of the outer nozzle pipe 4, the other nozzle opening 10 is blocked by the wall of the inner nozzle pipe 3 so that no wax can flow out of the nozzle opening 10.

If, in contrast, the outer nozzle pipe 3 is rotated about an axis of rotation by 90° relative to the inner nozzle pipe 3, the nozzle opening 10 aligns with borehole 16 and borehole 14 so that the wax can flow out through the nozzle opening 10 whereas the other nozzle opening 11 is blocked.

The outer nozzle pipe 4 can be rotated to the desired angular position by the driver 8 which, for this purpose, has a wrench surface 18 in which a correspondingly suitable wrench can engage. Furthermore, the driver 8 is connected in a form-fitting manner to the outer nozzle pipe 4. To this end, the outer nozzle pipe 4 has an axial re-entering groove on the front face into which engages a corresponding axially projecting tongue 19 of the driver 8.

Furthermore, the nozzle 1 according to the invention has a locking mechanism which is illustrated in FIGS. 5 and 6 and allows for the outer nozzle pipe 4 to be locked in one of four possible angular positions. To this end, the locking mechanism has an axially resilient slidable pressure piece 20, wherein the pressure piece 20 can engage into one of four locking receptacles 21-23 to lock the outer nozzle pipe 4 in a respective angular position. The locking receptacles 21-23 and the unidentifiable fourth locking receptacle are here mounted on the proximal front face of the outer nozzle pipe 4.

FIG. 8 illustrates an additional exemplary nozzle 24, which is generally designed in the manner described above and functions so that in this context, reference is made to the description above.

In this exemplary embodiment, however, using a bayonet fastener, the nozzle 24 is mounted in an application device 25 which, on the one hand, allows for the nozzle 24 to be actively rotated and on the other hand, also provides the coating agent (e.g. wax).

The invention is not limited to the exemplary embodiments described above. Instead, a plurality of variants and modifications are possible, which also make use of the concept of the invention and thus fall within the scope of protection. Furthermore, the invention also claims protection for the subject-matter and the features of the subclaims independently of the features of the claims to which they refer.

The invention claimed is:

1. A nozzle, comprising:

an elongated hollow lance configured for feeding a coating agent through the lance along a longitudinal axis of the lance, the lance including a hollow inner nozzle pipe and a hollow outer nozzle pipe that are arranged coaxially, wherein the outer nozzle pipe is rotatable about the longitudinal axis relative to the inner nozzle pipe;

at least two nozzle openings in the outer nozzle pipe that are each configured for dispensing the coating agent, including at least a first nozzle opening and a second nozzle opening that are an axial distance apart from one another and that are axially aligned with respect to the longitudinal axis so as to be at a same angular position with respect to a circumference of the outer nozzle pipe; and at least two radial boreholes in the inner nozzle pipe, including a first radial borehole at a first angular position with respect to a circumference of the inner nozzle pipe and a second radial borehole at a second angular position with respect to the circumference of the inner nozzle pipe, the first and second boreholes being spaced with respect to the longitudinal axis according to the axial distance.

2. The nozzle according to claim 1, wherein the inner nozzle pipe is stationary and the outer nozzle pipe is rotatable.

3. The nozzle according to claim 1, wherein:

the coating agent flows through the hollow inner nozzle pipe, and each of the first angular position and the second angular position are provided to allow the coating agent to flow out of the nozzle opening selectively via one and only one of the first radial borehole and the second radial borehole.

4. The nozzle according to claim 2, wherein the inner nozzle pipe and the outer nozzle pipe form a rotary slide valve having the outer nozzle pipe as a control element, wherein the rotary slide valve frees or locks the nozzle openings depending on a rotation of the outer nozzle pipe.

5. The nozzle according to claim 4, wherein the rotary slide valve frees or locks the nozzle openings in an essentially transition-free manner depending on a rotation of the outer nozzle pipe.

6. The nozzle according to claim 4, wherein the inner nozzle pipe has in its wall three or more radial boreholes that are arranged in different angular positions.

7. The nozzle according to claim 6, wherein each of the nozzle openings is assigned to one of the boreholes in the wall of the inner nozzle pipe.

8. The nozzle according to claim 1, wherein:

a sleeve-shaped gasket is arranged between the outer nozzle pipe and the inner nozzle pipe, the sleeve-shaped gasket surrounding the inner nozzle pipe in an annular manner, and the sleeve-shaped gasket is fixed relative to the outer nozzle pipe and has in its wall respective gasket radial boreholes aligned with the nozzle openings in the wall of the outer nozzle pipe.

9. The nozzle according to claim 8, wherein the sleeve-shaped gasket has an O-ring seal proximate to each of the gasket radial boreholes.

10. The nozzle according claim 1, further comprising a locking mechanism configured to lock the nozzle opening in a defined angular position.

11. The nozzle according to claim 10, wherein the locking mechanism includes at least one resilient pressure piece and at least one locking receptacle, wherein the pressure piece is arranged to lock in the locking receptacle to lock the nozzle in the defined angular position, and the pressure piece and the locking receptacle are arranged in respective parts of the nozzle that are rotatable relative to one another.

12. The nozzle according to claim 11, wherein the locking mechanism includes a plurality of locking receptacles to allow for a plurality of rotational positions of the nozzle.

13. The nozzle according to claim 1, wherein the nozzle includes a wrench surface to allow for rotation of the nozzle opening by a wrench to a desired rotational position, the wrench surface is formed on a driver that is connected in a form-fitting manner with the outer nozzle pipe, and the outer nozzle pipe on a front face of a wall, an axially re-entering groove, in which an accordingly axially projecting tongue on the driver is configured to engage to connect the driver in a form-fitting manner with the outer nozzle pipe.

14. The nozzle according to claim 1, wherein the nozzle opening is rotatable without any limitation of an angle of rotation.

15. The nozzle according to claim 1, wherein the nozzle is adapted for applying wax during seam sealing or for applying a preservation agent during cavity preservation on a vehicle body component.

16. The nozzle according to claim 1, wherein the nozzle opening is rotatable about the longitudinal axis of the lance such that the coating agent can be dispensed in different directions according to an angular position of the nozzle opening.

17. The nozzle according to claim 1, wherein the nozzle openings are arranged in a lateral surface of the lance to dispense the coating agent sideways with respect to the longitudinal axis of the lance.

18. An application device comprising a nozzle, the nozzle including: a pivoting apparatus for rotating the nozzle opening into a desired angular position;

an elongated hollow lance configured for feeding a coating agent through the lance along a longitudinal axis of the lance, the lance including a hollow inner nozzle pipe and a hollow outer nozzle pipe that are arranged coaxially, wherein the outer nozzle pipe is rotatable about the longitudinal axis relative to the inner nozzle pipe;

at least two nozzle openings in the outer nozzle pipe that are each configured for dispensing the coating agent, including at least a first nozzle opening and a second nozzle opening that are an axial distance apart from one another and that are axially aligned with respect to the longitudinal axis so as to be at a same angular position with respect to a circumference of the outer nozzle pipe; and at least two radial boreholes in the inner nozzle pipe, including a first radial borehole at a first angular position with respect to a circumference of the inner nozzle pipe and a second radial borehole at a second angular position with respect to the circumference of the inner nozzle pipe, the first and second boreholes being spaced with respect to the longitudinal axis according to the axial distance.

19. The application device according to claim 18, further comprising a bayonet fastener configured to releasably fix the nozzle in the application device.

20. A method, comprising using a nozzle to apply at least one of (i) wax during seam sealing and (ii) a preservation agent during cavity preservation on a vehicle body component, wherein the nozzle comprises:

an elongated hollow lance configured for feeding a coating agent through the lance along a longitudinal axis of the lance, the lance including a hollow inner nozzle pipe and a hollow outer nozzle pipe that are arranged coaxially, wherein the outer nozzle pipe is rotatable about the longitudinal axis relative to the inner nozzle pipe;

at least two nozzle openings in the outer nozzle pipe that are each configured for dispensing the coating agent, including at least a first nozzle opening and a second nozzle opening that are an axial distance apart from one another and that are axially aligned with respect to the longitudinal axis so as to be at a same angular position with respect to a circumference of the outer nozzle pipe; and at least two radial boreholes in the inner nozzle pipe, including a first radial borehole at a first angular position with respect to a circumference of the inner nozzle pipe and a second radial borehole at a second angular position with respect to the circumference of the inner nozzle pipe, the first and second boreholes being spaced with respect to the longitudinal axis according to the axial distance.

* * * * *